US011253890B2

(12) United States Patent
Horvath

(10) Patent No.: US 11,253,890 B2
(45) Date of Patent: Feb. 22, 2022

(54) UV COATING LAYER HARDENING DEVICE

(71) Applicant: Gusztav Horvath, Dronten (NL)

(72) Inventor: Gusztav Horvath, Dronten (NL)

( * ) Notice: Subject to any disclaimer, the term of this patent is extended or adjusted under 35 U.S.C. 154(b) by 0 days.

(21) Appl. No.: 16/484,082

(22) PCT Filed: Jun. 6, 2017

(86) PCT No.: PCT/NL2017/050371
§ 371 (c)(1),
(2) Date: Aug. 6, 2019

(87) PCT Pub. No.: WO2018/156016
PCT Pub. Date: Aug. 30, 2018

(65) Prior Publication Data

US 2020/0061666 A1 Feb. 27, 2020

(30) Foreign Application Priority Data

Feb. 6, 2017 (NL) ..... 2018316
Feb. 7, 2017 (NL) ..... 2018334

(51) Int. Cl.
*B05D 3/06* (2006.01)
*B05D 5/00* (2006.01)

(52) U.S. Cl.
CPC ..... *B05D 3/067* (2013.01); *B05D 5/005* (2013.01)

(58) Field of Classification Search
CPC ..... B05D 3/067; B05D 5/005; F26B 3/28
See application file for complete search history.

(56) References Cited

U.S. PATENT DOCUMENTS 8,421,043 B2 * 4/2013 Caiger ..... B05D 3/067 250/504 R
9,035,271 B2 * 5/2015 Wilson ..... B05D 3/067 250/504 H
10,677,417 B2 * 6/2020 Park ..... H01L 33/62
10,842,016 B2 * 11/2020 Bhat ..... H05K 1/0209
2002/0080615 A1 * 6/2002 Marshall ..... G02B 3/00 362/333

(Continued)

FOREIGN PATENT DOCUMENTS

WO 2014031095 A1 2/2014
WO 2017021504 A1 2/2017

*Primary Examiner* — Wyatt A Stoffa
(74) *Attorney, Agent, or Firm* — The Webb Law Firm

(57) ABSTRACT

The present invention relates to a UV coating layer hardening device for hardening of a coating in a repair workshop for an automobile by means of UV radiation suitable for irradiating of a coating layer to be hardened that is applied to a surface of the automobile, including: a number of bearer elements for bearing of a number of LED based UV radiation sources, optics per radiation source for spreading of the UV radiation at a predetermined manner under an irradiation angle, the number of UV radiation sources in cooperation with the respective optics per radiation source are arranged in such a manner that a predetermined area of the surface is arrangeable with an intensity or intensity per time period with a predetermined minimum and a predetermined maximum, in which the minimum provides a predetermined degree of hardening and in which the maximum does not exceed a certain threshold.

18 Claims, 12 Drawing Sheets

(56) References Cited

U.S. PATENT DOCUMENTS

| | | | | |
|---|---|---|---|---|
| 2011/0037084 | A1* | 2/2011 | Sekii | G02B 5/02 257/89 |
| 2011/0119949 | A1* | 5/2011 | Kites | F26B 3/28 34/275 |
| 2011/0222280 | A1* | 9/2011 | Kim | H01L 33/58 362/235 |
| 2012/0267647 | A1* | 10/2012 | Kim | H01L 25/0753 257/88 |
| 2013/0009179 | A1* | 1/2013 | Bhat | H05K 1/0209 257/89 |
| 2013/0021789 | A1 | 1/2013 | Dahm | |
| 2014/0038108 | A1 | 2/2014 | D'Amelio | |
| 2014/0246602 | A1* | 9/2014 | Wilson | B05D 3/067 250/492.1 |
| 2014/0246603 | A1* | 9/2014 | Wilson | G21K 5/00 250/492.1 |
| 2014/0316742 | A1* | 10/2014 | Sun | F21V 7/0091 702/167 |
| 2016/0059262 | A1 | 3/2016 | Seyler | |
| 2017/0043368 | A1* | 2/2017 | Wilson | B41F 23/00 |
| 2017/0097150 | A1* | 4/2017 | Chen | F26B 3/28 |
| 2018/0178247 | A1* | 6/2018 | Aizawa | H01L 33/62 |
| 2018/0221913 | A1* | 8/2018 | Wilson | B05C 21/00 |

* cited by examiner

UV COATING LAYER HARDENING DEVICE

BACKGROUND OF THE INVENTION

Field of the Invention

The present invention relates to a UV coating hardening layer device for hardening of a coating layer in a repair workshop for an automobile by means of UV radiation suitable for irradiating of a coating layer to be hardened that is applied to a surface of the automobile.

Description of Related Art

Automobiles, or parts thereof, are treated with a coating or an assembly of coatings for the purpose of a positive appearance, such as by color or shine, in the factory in which they are manufactured. In such a production factory, it is possible to apply coatings that are hardened under high temperatures, such as in an oven. The reason for this is that in a series production, manufacturing can be performed practically continuous and installations are arranged for that with an optimal speed in which the speed is a more important parameter than the size of the installation.

However, when repairing the automobiles, such as in case of damage or aging, individual automobiles are partly repaired, in which case it is not possible to treat the whole car in an oven for hardening of a coating. To this end, coatings, after applying thereof on a repaired vehicle, are hardened by means of direct radiation need, such as by means of an infrared lamp. Because of this, it is possible to perform jobs flexibly but the drying times are much longer than with mass production of the original automobile.

The present inventor thus determined a desire to shorten the drying time such that for example the automobile can remain in the cabin between the application of several layers of coating.

SUMMARY OF THE INVENTION

The present invention provides a UV coating layer hardening device for hardening of a coating layer in a repair workshop for an automobile by means of UV radiation suitable for irradiating of a coating layer to be hardened that is applied to a surface of the automobile, comprising:

- a number of bearer elements for bearing of a number of LED based UV radiation sources,
- optics per radiation source for spreading of the UV radiation at a predetermined manner under an irradiation angle,
- the number of UV radiation sources in cooperation with the respective optics per radiation source are arranged in an array in such a manner that a predetermined area of the surface is arrangeable with an intensity or intensity per time period with a predetermined minimum and a predetermined maximum, in which the minimum provides a predetermined degree of hardening and in which the maximum does not exceed a predetermined threshold.

An advantage of a device according to the present invention is that over the whole surface of the auto mobile provided with coating material, a hardening of high quality is realized.

It is of importance that the quantity of absorbed radiation energy is sufficient at each part of the surface. In other words, it is prevented that parts receive too little energy, and it is prevented that parts receive too much energy, or receive relatively too much energy.

A device according to the present invention allows for drying times that are a fraction of the drying times with a heat treatment, such as ⅙ to ½ thereof. In cases in which, with a substantially half hour drying time, it could be sensible to move the automobile, treat a further automobile with a coating and have the automobile receive heat treatment at another location, with the application of the present invention, it is sensible to leave the automobile at one location for all coating layers and at the same location subsequently perform the application of the coating layers with the execution of the hardening treatment.

A further advantage of the present invention is that a UV cover layer hardening device can be used in several treatment cabins for automobiles. The reason for this is that the device can be embodied with such a light weight that it is easily transportable between two or more adjacently arranged cabins.

Figure 1:
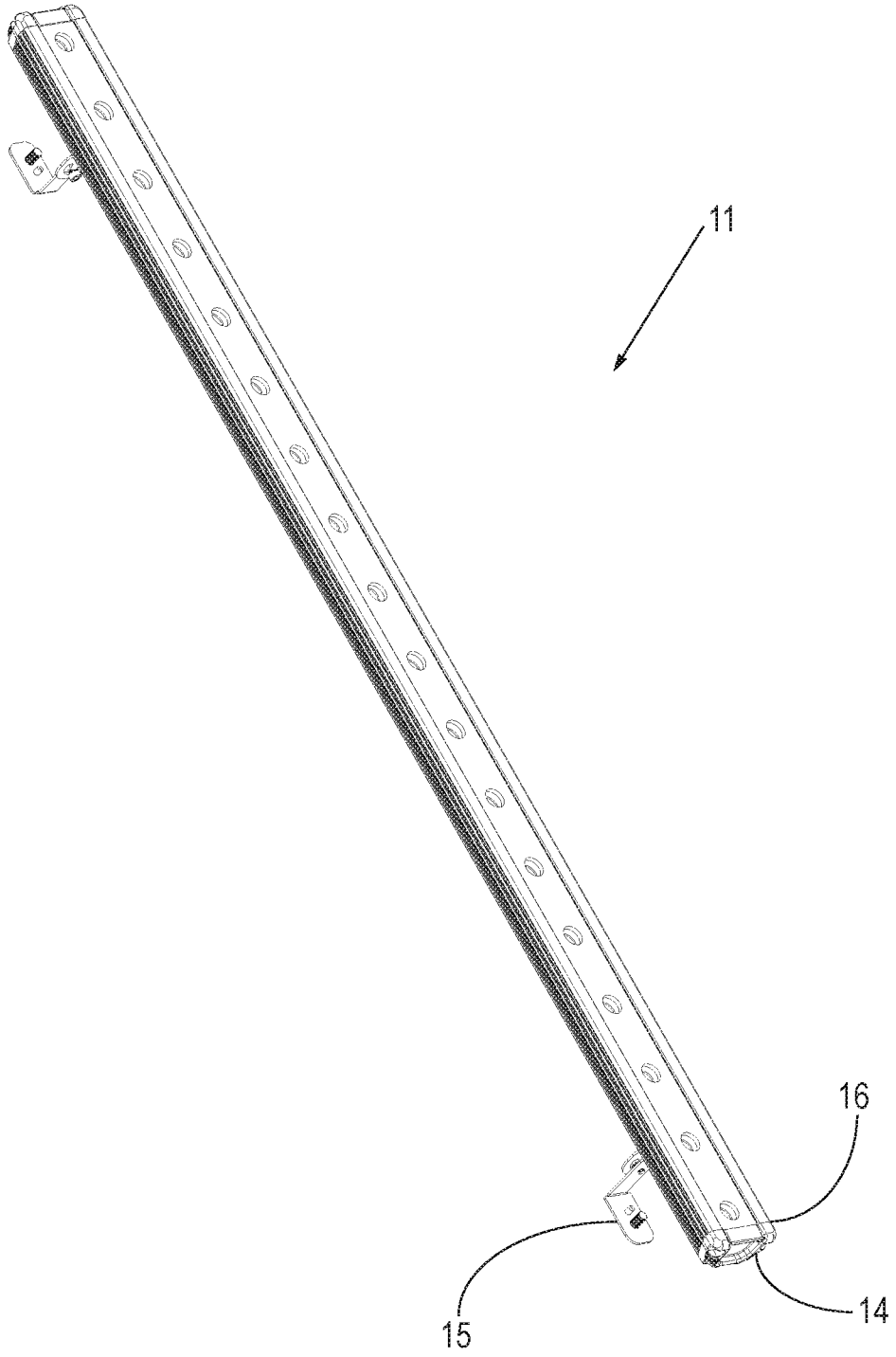
FIG. 1 is a perspective view of a first preferred embodiment according to the present invention.
Figure 2:
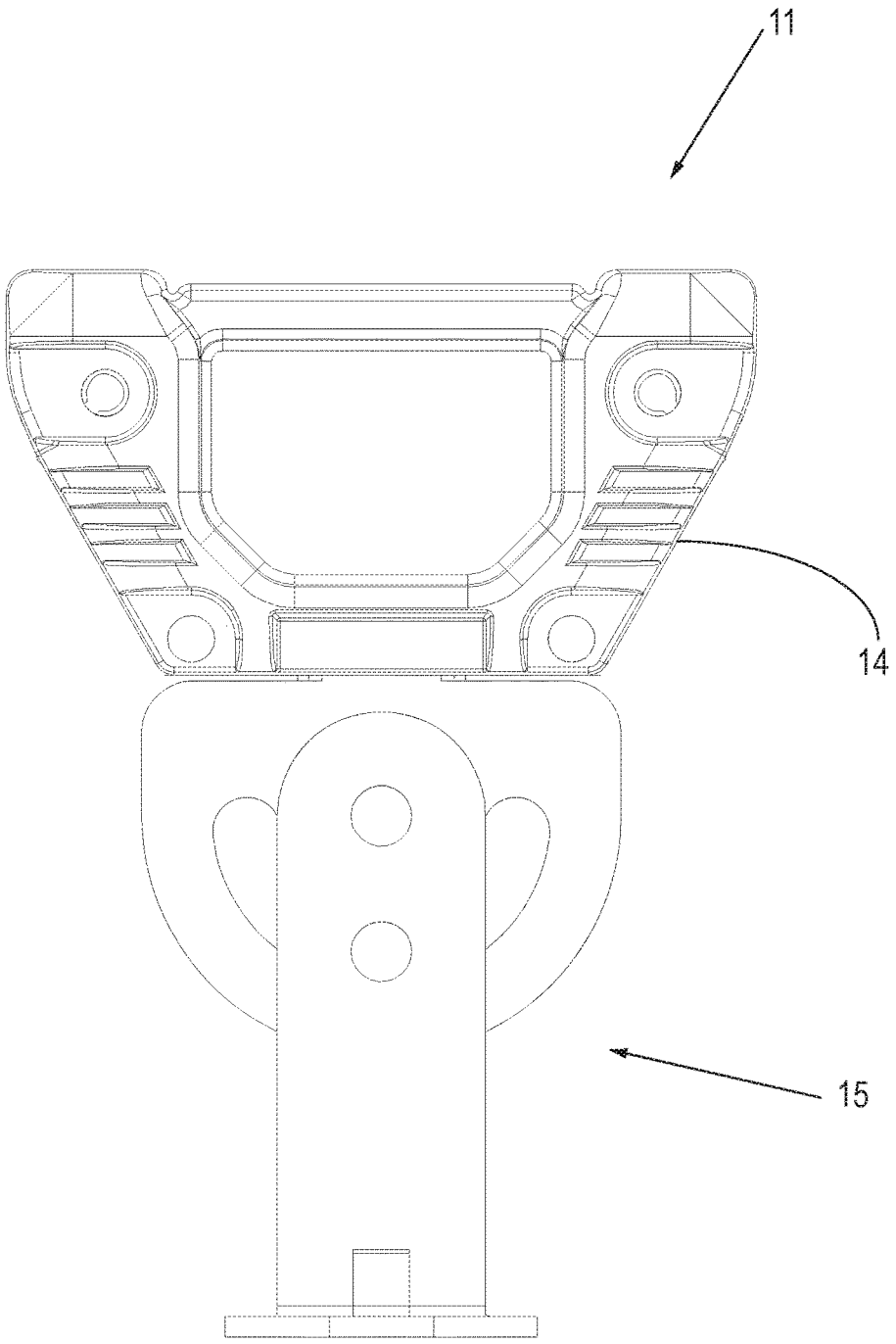
FIG. 2 is a side view of the embodiment of FIG. 1.

According to a first preferred embodiment, in a coating layer hardening device, the optics are arranged for irradiating of the UV radiation under an irradiation angle of 30-90°, preferably 40-80°, further preferably 45-75°, further preferably 50-70°, further preferably 55-65 to his, further preferably substantially 60°. Further preferably, as part of the optics, the UV radiation source are provided with a directly thereon arranged radiation source lens.

Further preferably, as part of the optics, the lens body is provided for taking and passing through of the UV radiation.

The device comprises an array of spreading elements, according to a further preferred embodiment, for towards the surface irradiated UV radiation, in which each spreading element is suitable for providing of the irradiation angle.

Further preferably, the array of spreading elements is formed in an irradiation surface of the lens body.

Further preferably, a bearer element comprises a carrier body that is formed as a profile, such as an extrusion profile.

According to a further preferred embodiment, the array of LED based UV radiation sources are arranged on a substrate, such as a circuit board.

Further preferably, the substrate is permanently coupled with a mass of the respective bearer element, preferably while applying a thermally conductive paste. Further preferably, in a bearer element the array is substantially arranged linearly.

Further preferably, the bearer element comprises a cover element that is penetrable to the UV radiation, preferably manufactured from a plastic, such as a poly methyl acrylate.

Further preferably, the device comprises a control unit for providing of a suitable electricity supply for each array of UV radiation sources.

Further preferably, the device comprises a registration unit for registry of the respective workloads of arrays of UV radiation sources.

Further preferably, in the device each bearer element or substrate part therein is provided with an identification, preferably in contact with control electronics thereof, wherein the registration is performed based on the identifications of an array of UV radiation sources, such as a serial number.

Further preferably, each bearer element fulfills a degree of predetermined watertightness and/or dust tightness, such as indicated with an IP 64, wherein further preferably connectors are comprised of connectors of the type XLR.

Further preferably, the device comprises an elongated sealing member, arranged between the carrier body and the cover element, further preferably kept under bias by means of a cover plate lock in element.

With this, preferably the array of UV radiation sources in cooperation with the respective optics per radiation source are arranged for treating of the surface within a predetermined distance range, in which preferably the distance range is within the range of 20 and 60 cm, further preferably between 30 and 50 cm, further preferably within 35 and 45 cm, further preferably substantially about 40 cm.

With this, further preferably the lens body is covered by an element for inhibiting of UV radiation.

According to a further preferred embodiment, the radiation sources are arranged for radiation of UV radiation with a wavelength between 350 and 440 nm, further preferably between 370 and 430 nm, further preferably between 380 and 420 nm, further preferably between 390 and 410 nm, further preferably between 400 and 10 nm, further preferably substantially with a highest intensity around 408 nm.

The number of bearer elements is arranged at a frame, in which at least a part of the number of bearer elements is arranged in parallel.

The frame further preferably comprises at least one subframe for thereto arranging of another part of the number of bearer elements.

With this, at least a single subframe is arranged movable, such as hingable relative to the frame.

A further aspect according to the present invention relates to a method for hardening of a cover layer under application of a UV cover layer hardening device suitable for irradiating by means of UV radiation of a surface of the surface of the automobile applied cover layer to be hardened, the method comprising steps for providing an automobile with a coating to be hardened and irradiating the coating to be hardened by means of the UV cover layer hardening device, preferably according to the present invention. Such method comprises advantages as indicated relating to earlier preferred embodiments.

An LED in the context of the present description irradiated slide in a wavelength as described.

Further advantages, features and details of the present invention will be further elucidated on the basis of a description of one or more embodiments with reference to the accompanying figures. Similar yet not necessarily identical parts of different preferred embodiments are indicated with the same reference numerals.

Figure 13:
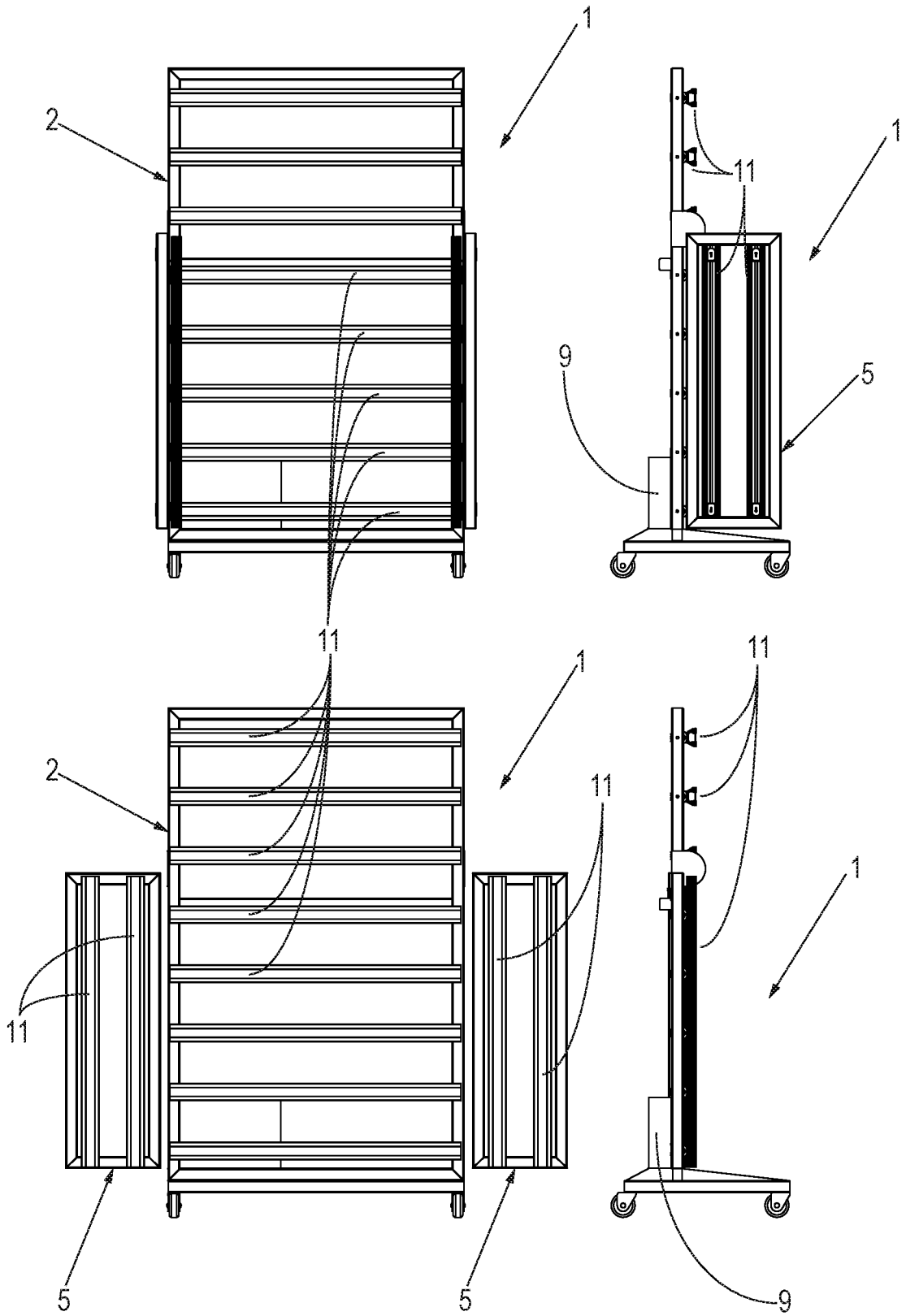
FIG. 13 is a preferred embodiment of a further device according to the present invention in several states of folding.

A first preferred embodiment according to the present invention relates to a UV cover layer hardening device 1 (FIG. 13). This comprises a number of bearer elements 11 (FIGS. 1-5, 8, and 9) bearing LED based UV radiation sources 12 for providing of an even irradiation of a surface of an automobile. The radiation sources are also provided with optics 12. The optics are formed by a radiation source lens directly on the LED, which LED is arranged at a circuit board that is arranged directly against the profile forming the body of the respective bearer element by means of heat paste.

Figure 11:
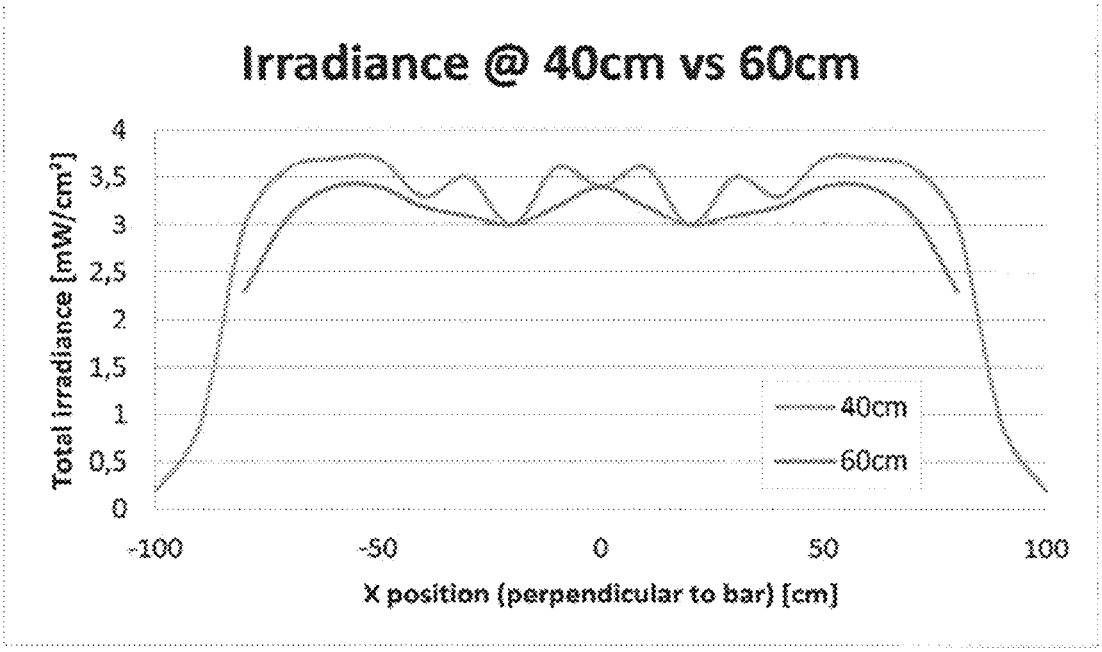
FIG. 11 is a graph representing irradiation power per surface area, as provided with a device according to the present invention.
Figure 12:
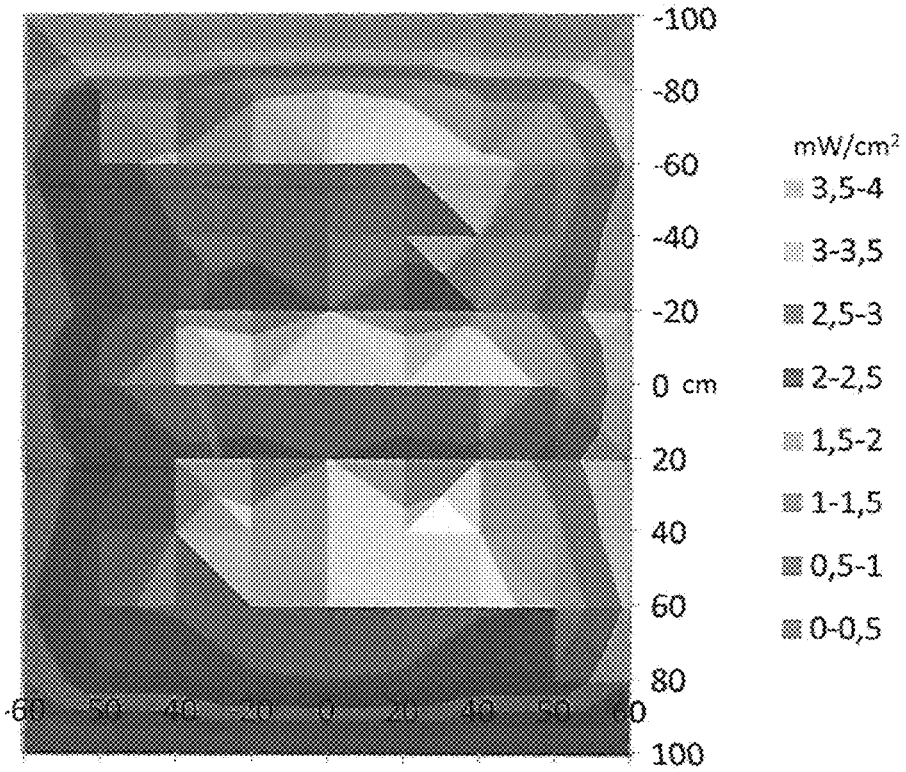
FIG. 12 is a graph representing irradiation power per surface area as provided with a device according to the present invention.

The bearer elements 11 are arranged at a frame 2 in a mutual substantially equal distance. By means of this arrangement, the LEDs provide an irradiation towards the surface according for example a graph of FIG. 11 and FIG. 12. Therein, it is shown how the radiation is relatively evenly achieved between an intensity of substantially 3 to 3.5 $mW/cm^2$ in FIG. 11.

The bearer element is built up on the basis of the profile 15 comprising cooling ribs 17 for cooling of the bearer element 11. The UV light sources 12 are arranged in a circuit board 31 that is connected to a power supply 57 that is arranged at the frame. The cooling of the circuit board with therein arranged radiation sources is furthermore optimized by applying heat paste such as comprising an in oil mixed amount of silver particles.

Figure 6:
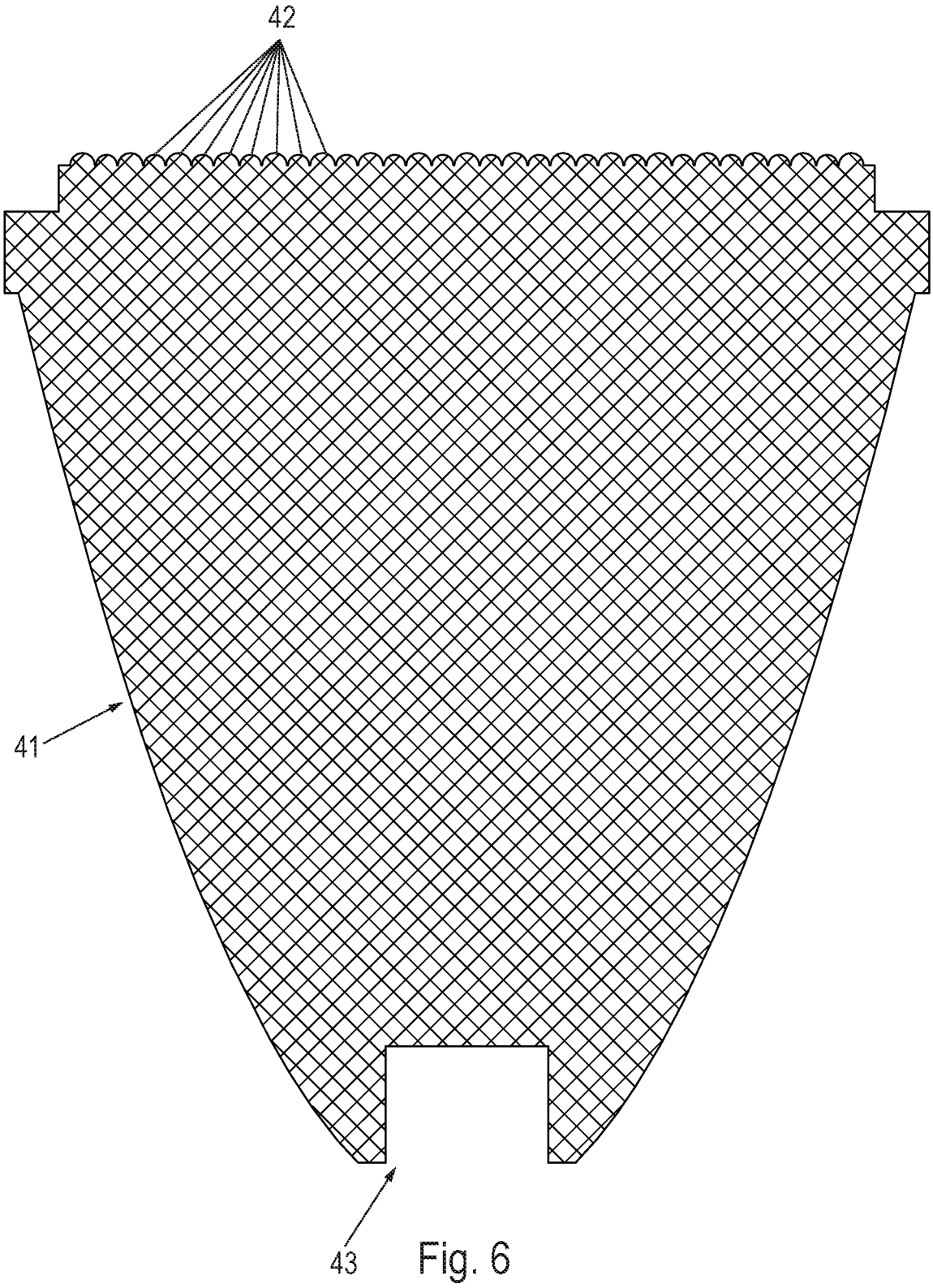
FIG. 6 is a cross-section view of a preferred embodiment of a part of the preferred embodiment of FIG. 1.
Figure 7:
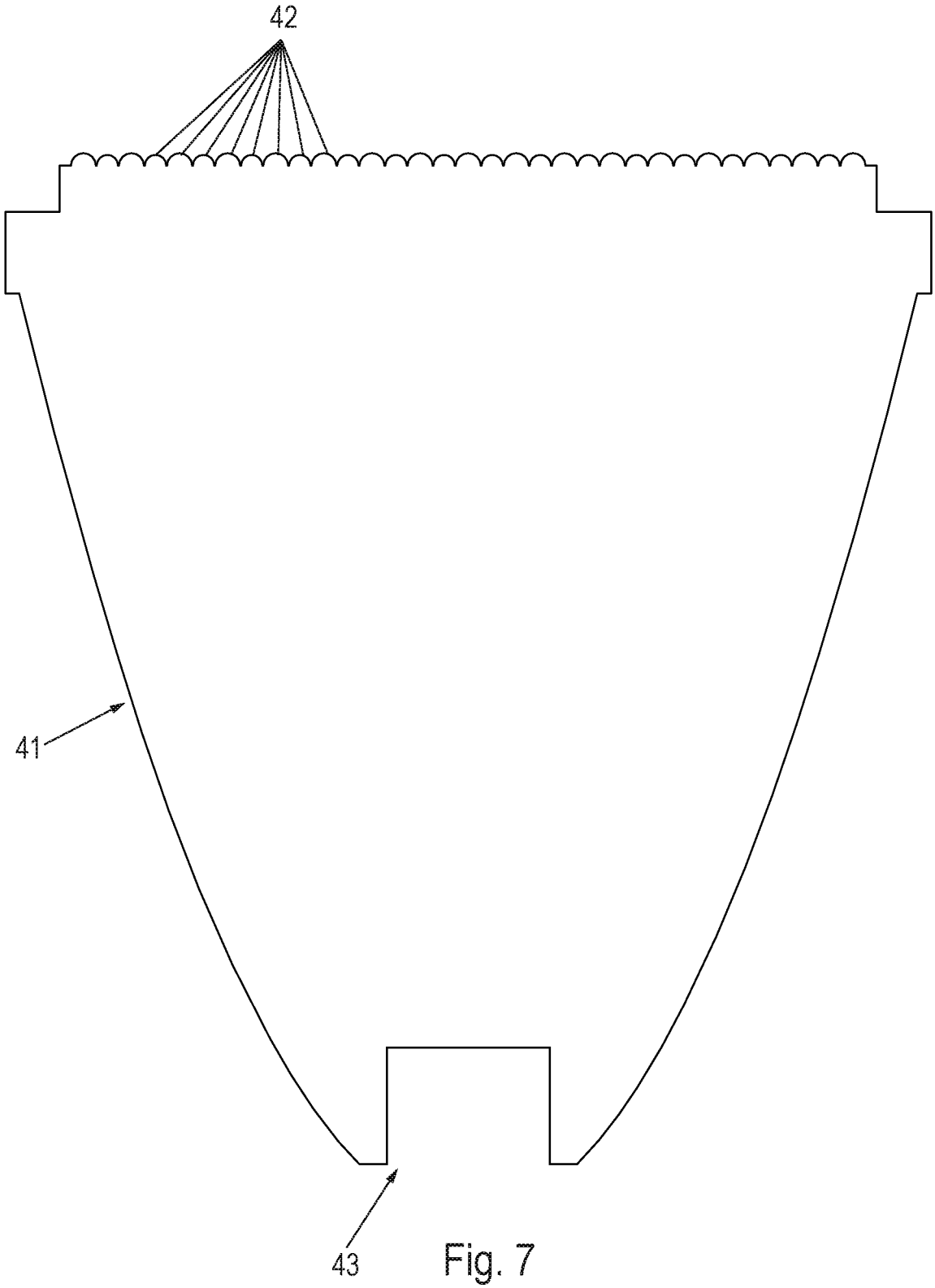
FIG. 7 is an outline of the cross-section of FIG. 6.
Figure 8:
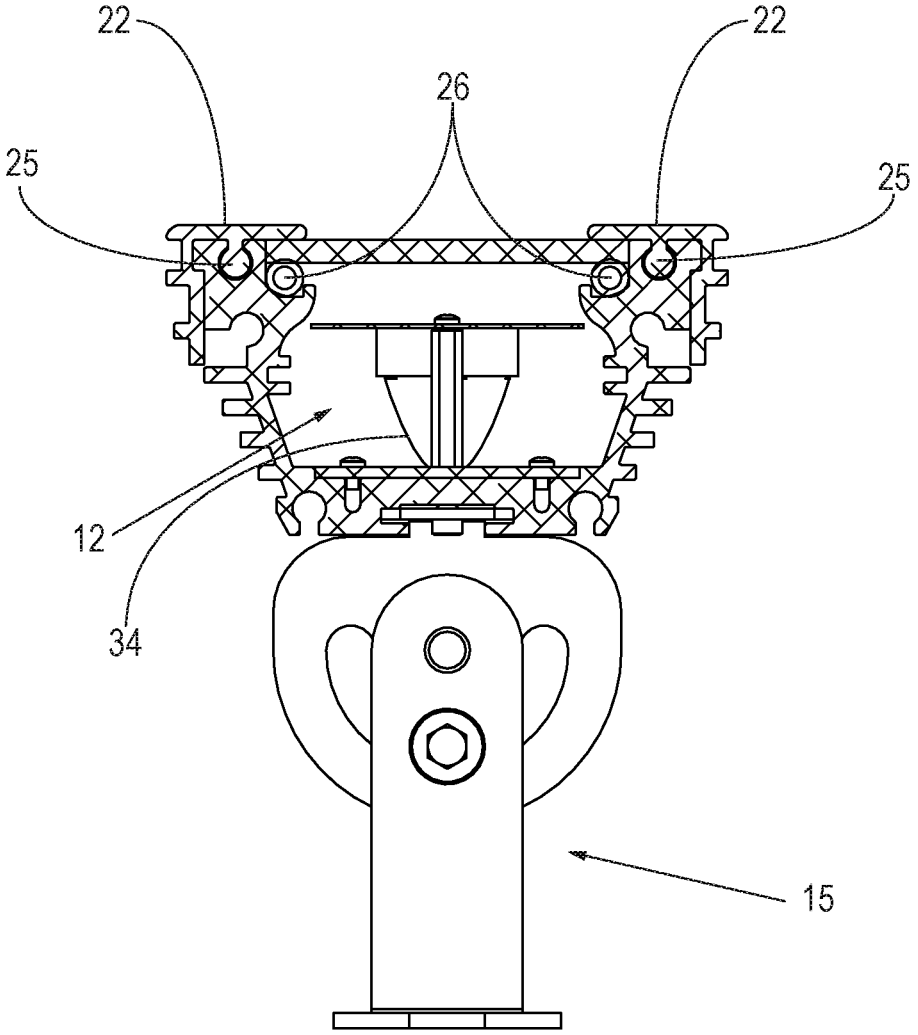
FIG. 8 is a cross-section of the preferred embodiment according to FIG. 1.
Figure 9:
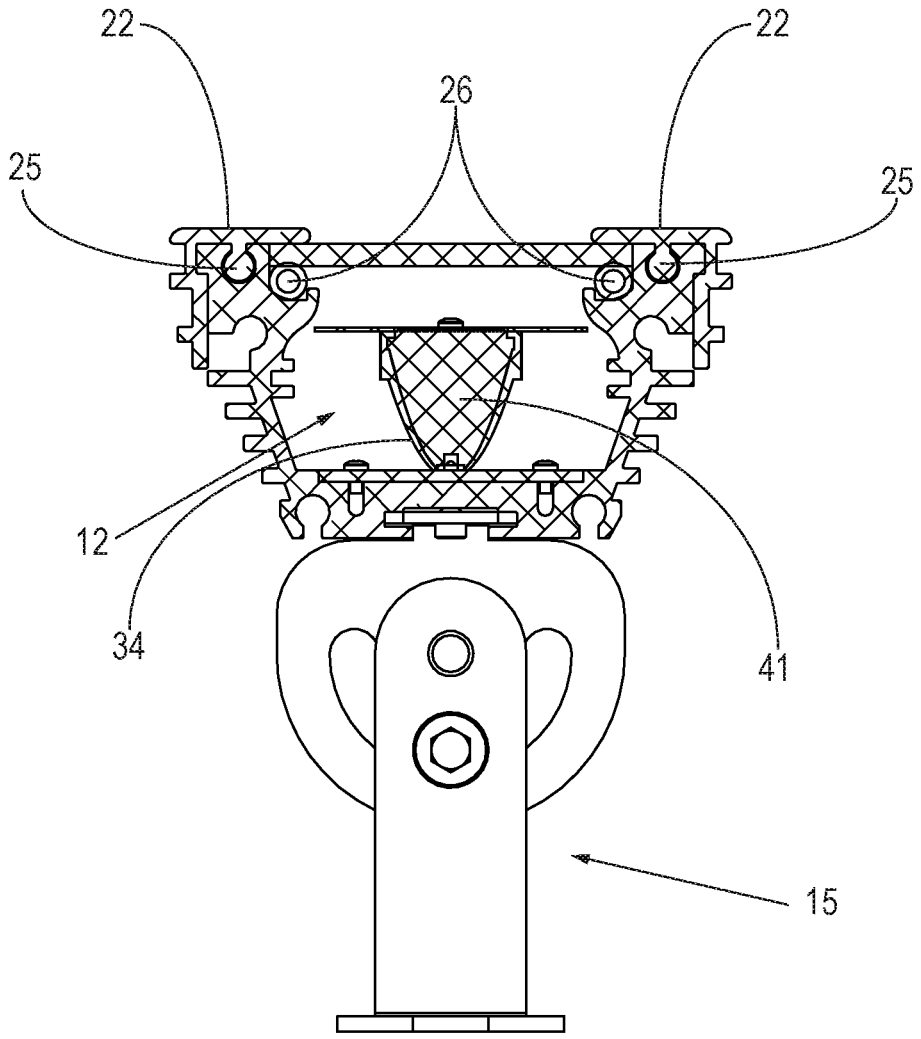
FIG. 9 is a further cross-section view of the preferred embodiment according to FIG. 1 at the location of a part according to FIG. 6.
Figure 10:
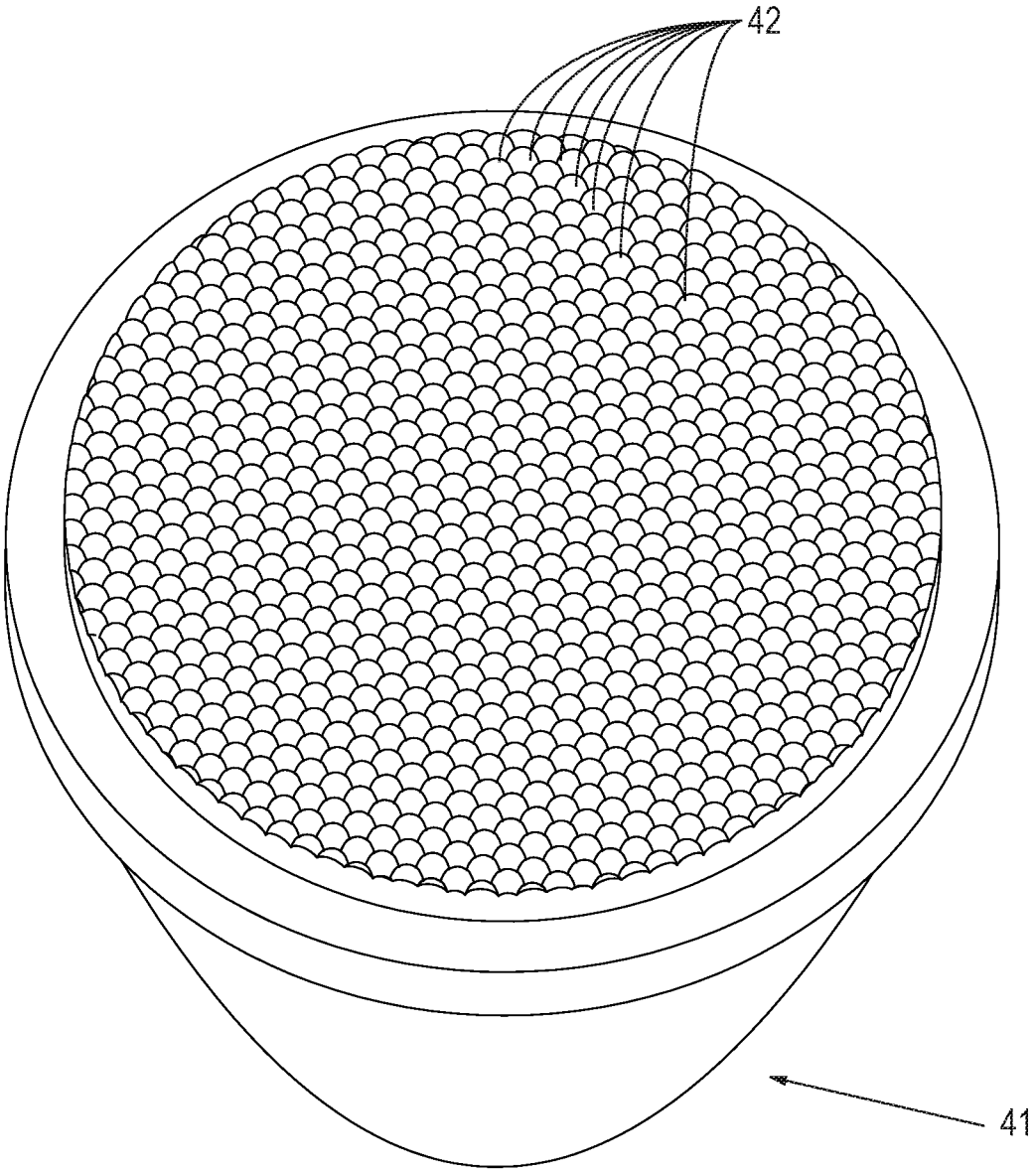
FIG. 10 is a perspective view of a part according to FIG. 6.

At the UV light source 12, a spherical or semi spherical lens 13 is arranged with a UV penetrable UV resistant material, such as a silicone or a polymethylacrylate. Over the radiation source lens 13, a lens body 41 (FIG. 6, 7) is arranged that is provided at the bottom side with an opening 43 for arrangement of the spherical radiation source lens 13. At the upper side of the lens 41 an array of lenses 42 is arranged in a matrix, in this example arranged in a honeycomb structure, such as is shown in FIG. 10. Each of these matrix lenses 42 is formed for providing of the predetermined irradiation angle such as preferably 60%.

The lens body 41 is surrounded by a radiation barrier body 34 for directing of substantially the whole of the radiation in upward direction toward the lenses 42. With this, it is also prevented that UV light is irradiated within the profile 15 which protects the electronics therein.

For the purpose of closing off of the profile 15, at the upper side a plate 21 is arranged that is clamped between an edge 28 of the profile and the slide in profiles 22 that are provided with an in cross-section circular sliding edge for arranging in the circular slot 24. For the purpose of substantially dustproof and waterproof sealing, clamped-in rubber or plastic string 26 is provided. This clamps the plate 21 over the whole length upwardly toward the slide in profiles from the edge 28.

With this, it is achieved that the profile is closed over the whole length. At the head ends of the profile, the profile is closed by means of caps 14 with between the caps and the profile a silicone seal.

Figure 3:
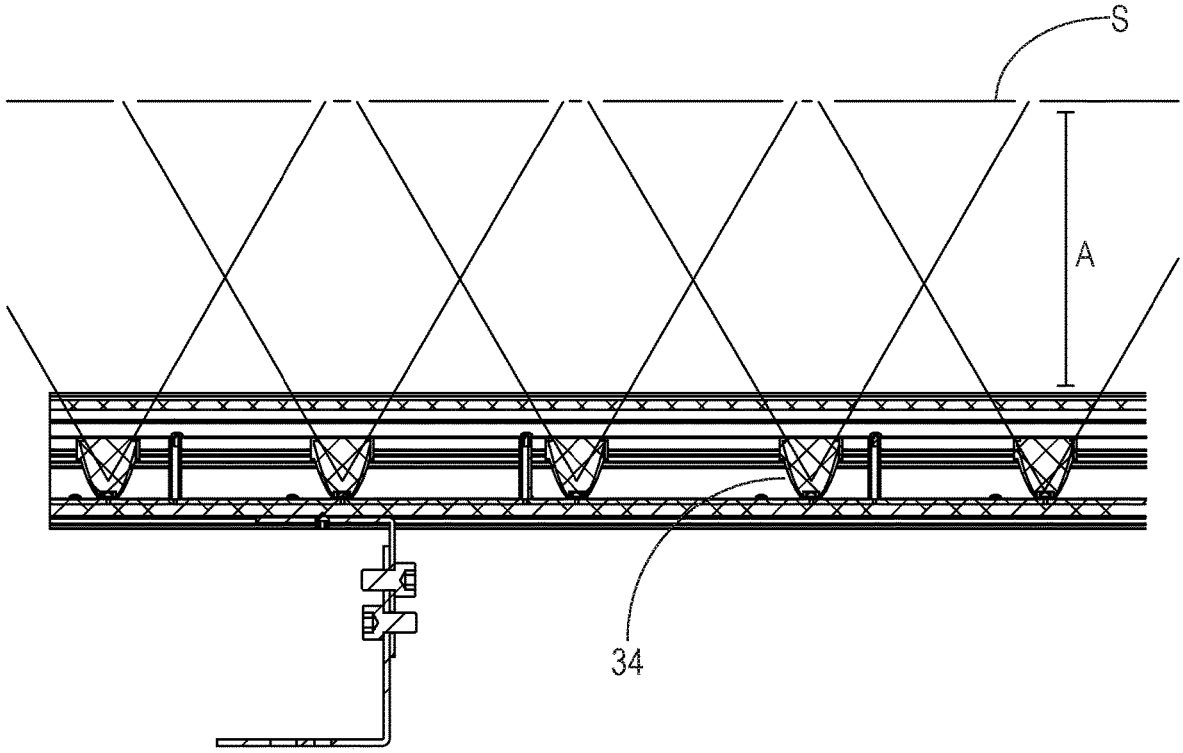
FIG. 3 is a cross-section view with a radiation pattern of the embodiment of FIG. 1.
Figure 4:
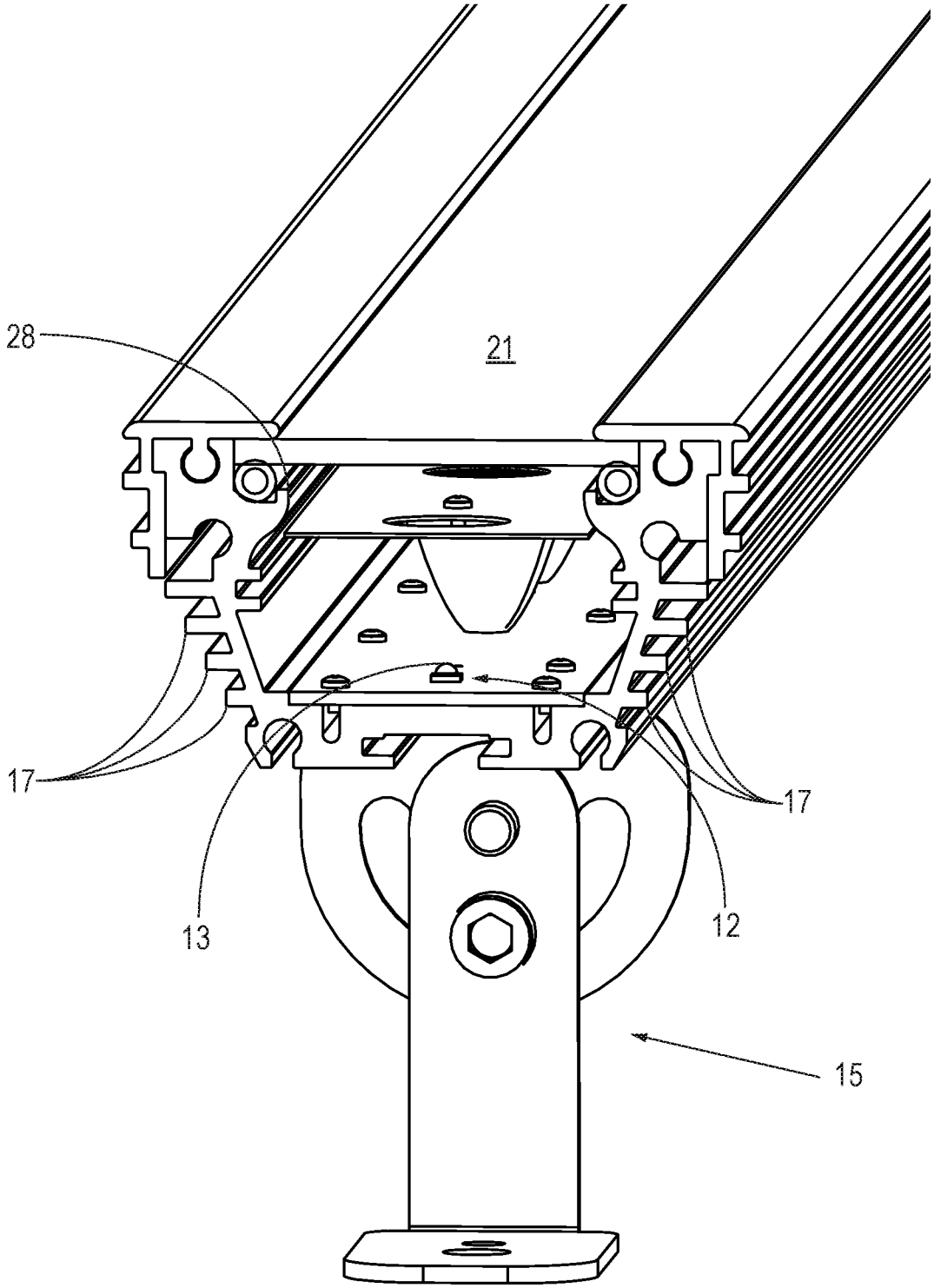
FIG. 4 is a perspective view of a partially disassembled specimen of the embodiment of FIG. 1.
Figure 5:
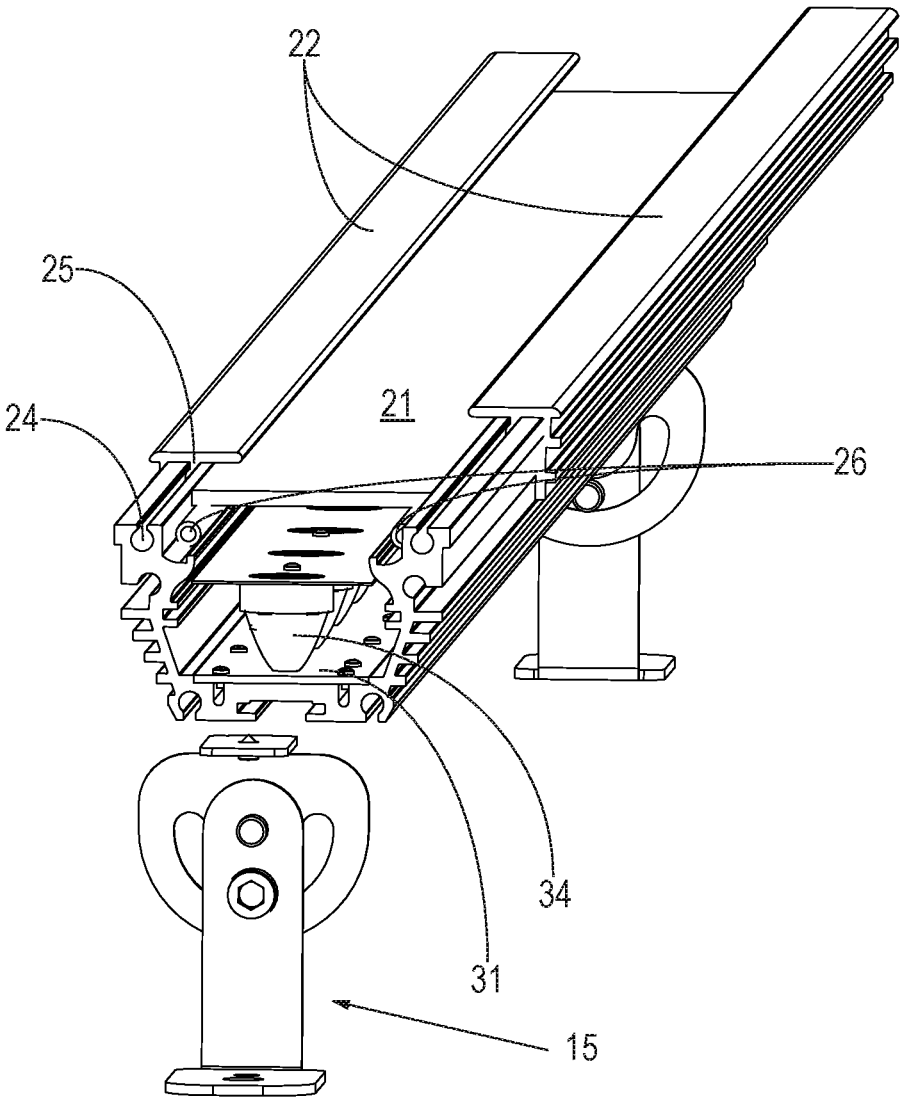
FIG. 5 is a perspective view of further disassembled specimen of FIG. 4.

In FIG. 3, it is shown how, in side view, the radiation bundles radiated towards a surface as at the indicated preferred distance.

The frame 2 is provided with two wings 5 arranged at the side with which coated parts of an automobile part substantially at the preferred distance are being irradiated. Depending on the type of vehicle that is irradiated, the frame is given such a shape that within the understanding of the present invention all of the surface may be irradiated from the preferred distance for sufficiently uniform irradiation. The present invention is described in the foregoing on the basis of several preferred embodiments. Different aspects of different embodiments can be combined, wherein all combinations which can be made by a skilled person on the basis of this document must be included. These preferred embodiments are not limitative for the scope of protection of this document. The rights sought are defined in the appended claims.

The invention claimed is:

1. A UV coating layer hardening device for hardening of a coating layer in a repair workshop for an automobile by means of UV radiation suitable for irradiating of a coating layer to be hardened that is applied to a surface of the automobile, comprising:

a number of bearer elements each bearing of a number of LED based UV radiation sources, optics per radiation source for spreading of the UV radiation at a predetermined manner under a irradiation angle, wherein the optics per radiation source includes a lens body for taking in and passing through of the UV radiation and a spherical or semi-spherical radiation source lens directly arranged on the UV radiation source between the lens body and the UV radiation source, wherein the lens body includes: a bottom including an opening for receiving the radiation source lens, and an upper side opposite the bottom and including an array of convex lenses arranged in a matrix, wherein each said convex lens has a different focal point, the number of UV radiation sources in cooperation with the respective optics per radiation source are arranged in an array in such a manner that a predetermined area of the surface is irradiatable with UV radiation with an intensity or intensity per time period with a predetermined minimum and a predetermined maximum, in which the minimum provides a predetermined degree of hardening and in which the maximum does not exceed a predetermined threshold.

2. The UV coating layer hardening device according to claim 1, in which the optics are arranged for irradiating of the UV radiation under the irradiation angle of 30-90°.

3. The UV coating layer hardening device according to claim 1 wherein the array of convex lenses spread towards the surface irradiated UV radiation, in which each said convex lens is configured to provide the irradiation angle.

4. The UV coating layer hardening device according to claim 3, in which the array of convex lenses is formed in an irradiation surface of the lens body.

5. The UV coating layer hardening device according to claim 1, in which a bearer element comprises a carrier body that is formed as a profile.

6. The UV the coating layer hardening device according to claim 1, in which the number of UV radiation sources are arranged on a substrate.

7. The UV coating layer hardening device according to claim 6, in which the substrate is permanently coupled with a body of a respective bearer element.

8. The UV coating layer hardening device according to claim 1, in which in a bearer element the number of UV radiation sources is substantially arranged linearly.

9. The UV coating layer hardening device according to claim 1, in which a bearer element comprises a cover element that is penetrable to the UV radiation.

10. The UV cover layer hardening device according to claim 1, comprising a control unit for providing of an electricity supply for each number of UV radiation sources.

11. The UV cover layer hardening device according to claim 1, in which the bearer element fulfills a predetermined watertightness and/or dust tightness rating.

12. The UV cover layer hardening device according to claim 9 comprising an elongated sealing member, arranged between a body of the bearer element and the cover element.

13. The UV cover layer hardening device according to claim 1 in which the number of UV radiation sources in cooperation with the respective optics per radiation source are arranged for treating of the surface within a predetermined distance range.

14. The UV cover layer hardening device according to claim 1, in which the UV radiation sources are arranged for radiation of UV radiation with a wavelength between 350 and 440 nm.

15. The UV cover layer hardening device according to claim 1, in which the number of bearer elements is arranged at a frame, in which at least a part of the number of bearer elements is arranged in parallel.

16. The UV cover layer hardening device according to claim 15, in which the frame comprises at least one subframe for thereto arranging of another part of the number of bearer elements.

17. The UV cover layer hardening device according to claim 16, in which the at least one subframe is arranged movable.

18. The UV cover layer hardening device according to claim 1, wherein convex sides of the array of convex lenses face away from the opening in the bottom of the lens body.

* * * * *